US008281894B2

(12) United States Patent
Mordecai et al.

(10) Patent No.: US 8,281,894 B2
(45) Date of Patent: Oct. 9, 2012

(54) FLOATING HARNESS

(75) Inventors: Mark Mordecai, Hampton, NH (US); Julie Snedeker, Northwood, NH (US); John R. Yates, Redding, CA (US)

(73) Assignee: Globe Holding Company LLC, Pittsfield, NH (US)

( * ) Notice: Subject to any disclaimer, the term of this patent is extended or adjusted under 35 U.S.C. 154(b) by 995 days.

(21) Appl. No.: 11/677,209

(22) Filed: Feb. 21, 2007

(65) Prior Publication Data

US 2007/0204377 A1 Sep. 6, 2007

Related U.S. Application Data

(60) Provisional application No. 60/775,230, filed on Feb. 21, 2006.

(51) Int. Cl.
*A62B 35/00* (2006.01)
*A62B 5/00* (2006.01)

(52) U.S. Cl. ..... 182/3

(58) Field of Classification Search ..... 182/6, 3, 182/5; 119/792, 793, 857, 907
See application file for complete search history.

(56) References Cited

U.S. PATENT DOCUMENTS

| | | | | | |
|---|---|---|---|---|---|
| 702,858 | A | * | 6/1902 | Hendricks et al. | 182/6 |
| 2,475,631 | A | * | 7/1949 | Miller et al. | 244/151 R |
| 3,424,134 | A | | 1/1969 | Rosenblum | |
| 3,869,021 | A | * | 3/1975 | Sutherland et al. | 182/3 |
| 3,973,643 | A | | 8/1976 | Hutchinson | |
| 4,446,943 | A | | 5/1984 | Murray | |
| 4,632,217 | A | | 12/1986 | Markwell et al. | |
| 4,922,860 | A | * | 5/1990 | Hutchings | 482/69 |
| 5,036,548 | A | | 8/1991 | Grilliot et al. | |
| 5,136,724 | A | | 8/1992 | Grilliot et al. | |
| 5,145,027 | A | | 9/1992 | Petzl et al. | |
| 5,289,590 | A | | 3/1994 | Larson | |
| 5,388,551 | A | * | 2/1995 | Martusciello | 119/770 |
| 5,445,114 | A | | 8/1995 | Walker | |
| 5,615,750 | A | | 4/1997 | Phillips | |
| 6,035,966 | A | * | 3/2000 | Lewis | 182/7 |
| 6,050,364 | A | * | 4/2000 | Popall et al. | 182/6 |
| 6,244,379 | B1 | * | 6/2001 | Larson | 182/6 |
| 6,308,335 | B1 | * | 10/2001 | Colorado | 2/81 |
| 6,431,313 | B1 | | 8/2002 | Petzl et al. | |
| 6,490,733 | B1 | * | 12/2002 | Casaubon | 2/81 |
| 6,658,666 | B2 | * | 12/2003 | Schweer | 2/94 |
| 6,892,395 | B2 | * | 5/2005 | Schweer | 2/94 |
| 2003/0146044 | A1 | * | 8/2003 | Jordan | 182/3 |
| 2009/0077725 | A1 | * | 3/2009 | Waters et al. | 2/458 |

OTHER PUBLICATIONS

The American Heritage® Dictionary of the English Language, Fourth Edition copyright © 2000 by Houghton Mifflin Company. Updated in 2009. Published by Houghton Mifflin Company. All rights reserved. see Action for definition.*

(Continued)

*Primary Examiner* — Katherine w Mitchell
*Assistant Examiner* — Daniel Cahn
(74) *Attorney, Agent, or Firm* — Finch & Maloney PLLC

(57) ABSTRACT

A safety harness and a method of integrating the safety harness into apparel such as a firefighter's turnout suit. The safety harness may include a waist strap, a leg strap for encircling a wearer's leg, and a support strap slideably attached to the waist strap.

10 Claims, 9 Drawing Sheets

OTHER PUBLICATIONS definition of 'unitary' found in Action The American Heritage® Dictionary of the English Language, Fourth Edition copyright © 2000 by Houghton Mifflin Company. Updated in 2009. Published by Houghton Mifflin Company. All rights reserved.* definition of 'fixed' found in Action The American Heritage® Dictionary of the English Language, Fourth Edition copyright © 2000 by Houghton Mifflin Company. Updated in 2009. Published by Houghton Mifflin Company. All rights reserved.* definition of 'floating' found in Action The American Heritage® Dictionary of the English Language, Fourth Edition copyright © 2000 by Houghton Mifflin Company. Updated in 2009. Published by Houghton Mifflin Company. All rights reserved.* definition of "along" found in Action The American Heritage® Dictionary of the English Language, Fourth Edition copyright © 2000 by Houghton Mifflin Company. Updated in 2009. Published by Houghton Mifflin Company. All rights reserved.*

Gemtor #541NYC—Class II Fire Service Harness, Aug. 2007, 1 page, http://www.gemtor.com/541NYC_flyer.pdf, downloaded Oct. 22, 2008.

Gemtor . . . when you life is on the line, 1 page, Gemtor, Inc., Matawan, NJ.

* cited by examiner

FLOATING HARNESS

RELATED APPLICATION

This application claims benefit of U.S. Provisional Patent Application Ser. No. 60/775,230, titled "FLOATING HARNESS" filed Feb. 21, 2006 and which is hereby incorporated by reference herein.

BACKGROUND

1. Field of Invention

The invention relates to a safety harness, and in particular, to a floating safety harness that may be integrated into apparel such as a firefighter's turnout suit.

2. Discussion of Related Art

Firefighters and other emergency or first responders traditionally wear outer clothing known in the art as a turnout suit. The turnout suit protects the firefighter against flame, heat, and water. Typically, a turnout suit includes a coat and trousers that each have an inner liner and an outer layer. The shell or outer layer is constructed from materials that can be resistant to abrasion, flame, heat, and water. The inner liner, typically releasably secured to the outer layer to permit the liner to the removed for cleaning and repair purposes, is preferably constructed from thermal and/or wicking materials.

In addition to the turnout suit, firefighters may wear other equipment such as boots, helmet, gloves, and a self-contained breathing apparatus (SCBA). This ensemble can be heavy and bulky. Thus there is understandably a resistance to add any further equipment to what is already in use.

Nonetheless, the nature of firefighting and emergency response requires that responders carry more equipment in certain instances. Traditionally, firefighters have carried ropes and an emergency climbing harness to help them escape safely from the top floors of burning buildings. The ropes and climbing harness are frequently referred to as personal fall protection equipment (PFE). The PFE, when worn, provides a reliable fastening point on the user's body that enables coupling to an anchor point and thus facilitates a safe escape. However, such additional PFE equipment can be bulky and therefore may not always be carried by the firefighter into the building. Even when the PFE is readily available, in an emergency situation it can be difficult and time consuming to don it. Therefore, the inventors believe there exists a need in the art for firefighter turnout gear that incorporates escape and rescue means without adding substantial weight to the ensemble.

SUMMARY OF INVENTION

In one aspect, a floating harness is provided, the harness comprising a waist strap, a leg strap of fixed circumference and a support strap slideably attached to the waist strap, the support strap fixed to the leg strap.

In another aspect, a firefighter's trouser for retaining a floating harness is provided, the harness comprising a torso section including a rear portion and a front portion, two leg portions attached to the torso portion, a retainer for retaining a waist strap of the floating harness to an inside surface of the trousers, a waistband defining a guide, the guide oriented substantially vertically in the waistband, the guide constructed and arranged to slideably receive a support strap of a floating harness, and an opening for the waist strap to enable the waist strap to be fastened externally of the trousers.

In another aspect, a firefighter's ensemble is provided, the ensemble comprising a floating harness integrated seamlessly into a firefighter's apparel such as a trouser is provided. The floating harness includes a waist strap, a leg strap for encircling a firefighter's leg, and a support strap slideably attached to the waist strap. The trousers of the firefighter's ensemble include a waistband defining a guide for receiving the support strap wherein the support strap is retractably retained by the guide, and a retainer for slideably retaining a waist strap of the floating harness to an inside surface of the trousers.

In another aspect, firefighter's trousers for retaining a floating harness are provided, the trousers comprising a belt retainer attached to an outer surface of the trousers, the belt retainer including two slots for passage of a harness waist strap and a slot for passage of a harness support strap, and a slit passing through at least an exterior surface of the trousers whereby the slit provides a passageway for the support strap from an interior surface of the trousers to the exterior surface of the trousers.

BRIEF DESCRIPTION OF DRAWINGS

Many features of the invention will be more readily understood by reference to the following detailed description, taken with reference to the accompanying drawings representing different embodiments, in which.

DETAILED DESCRIPTION

Figure 1:
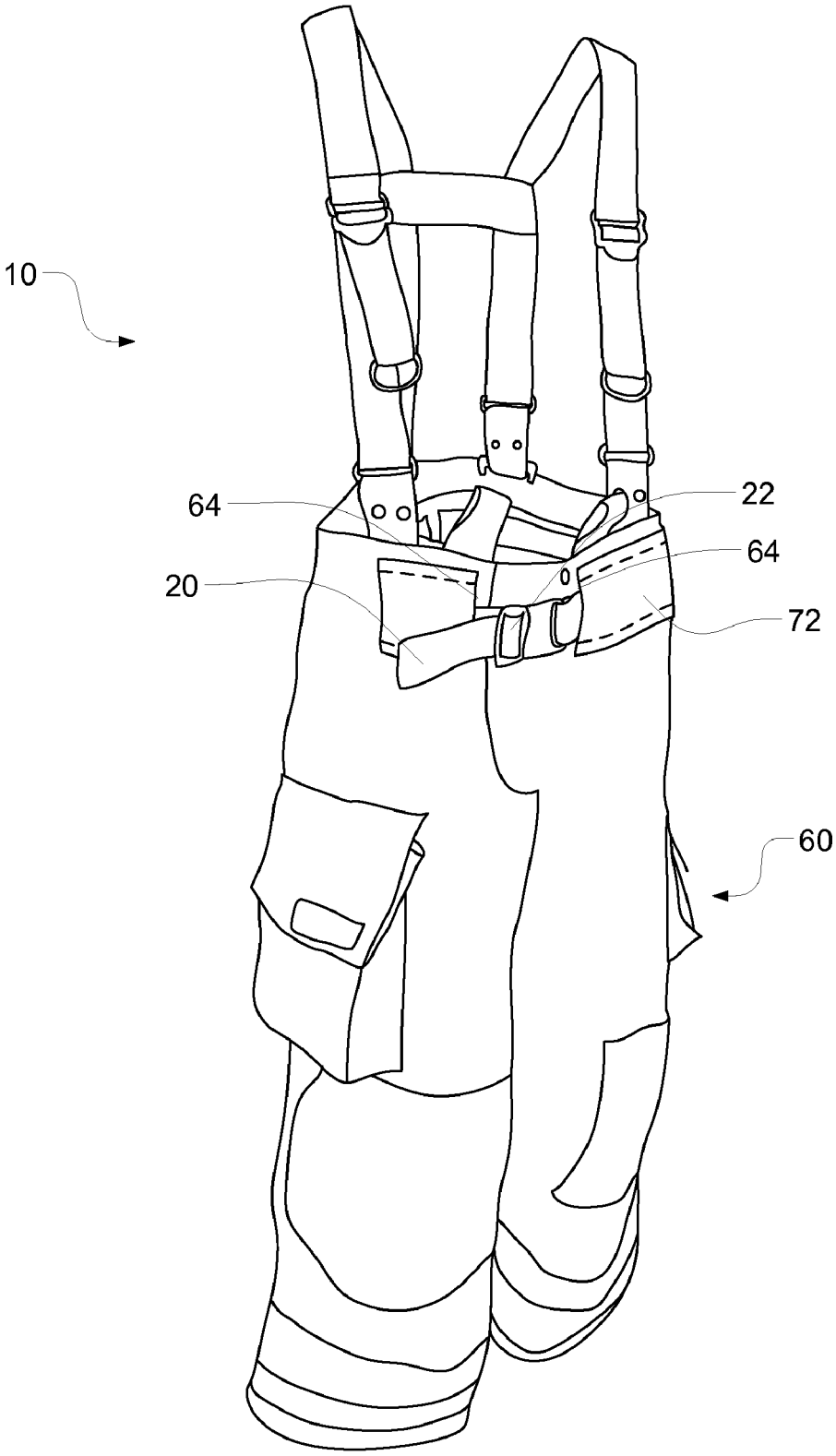
FIG. 1 provides a perspective view of a safety harness and trousers.
Figure 2:
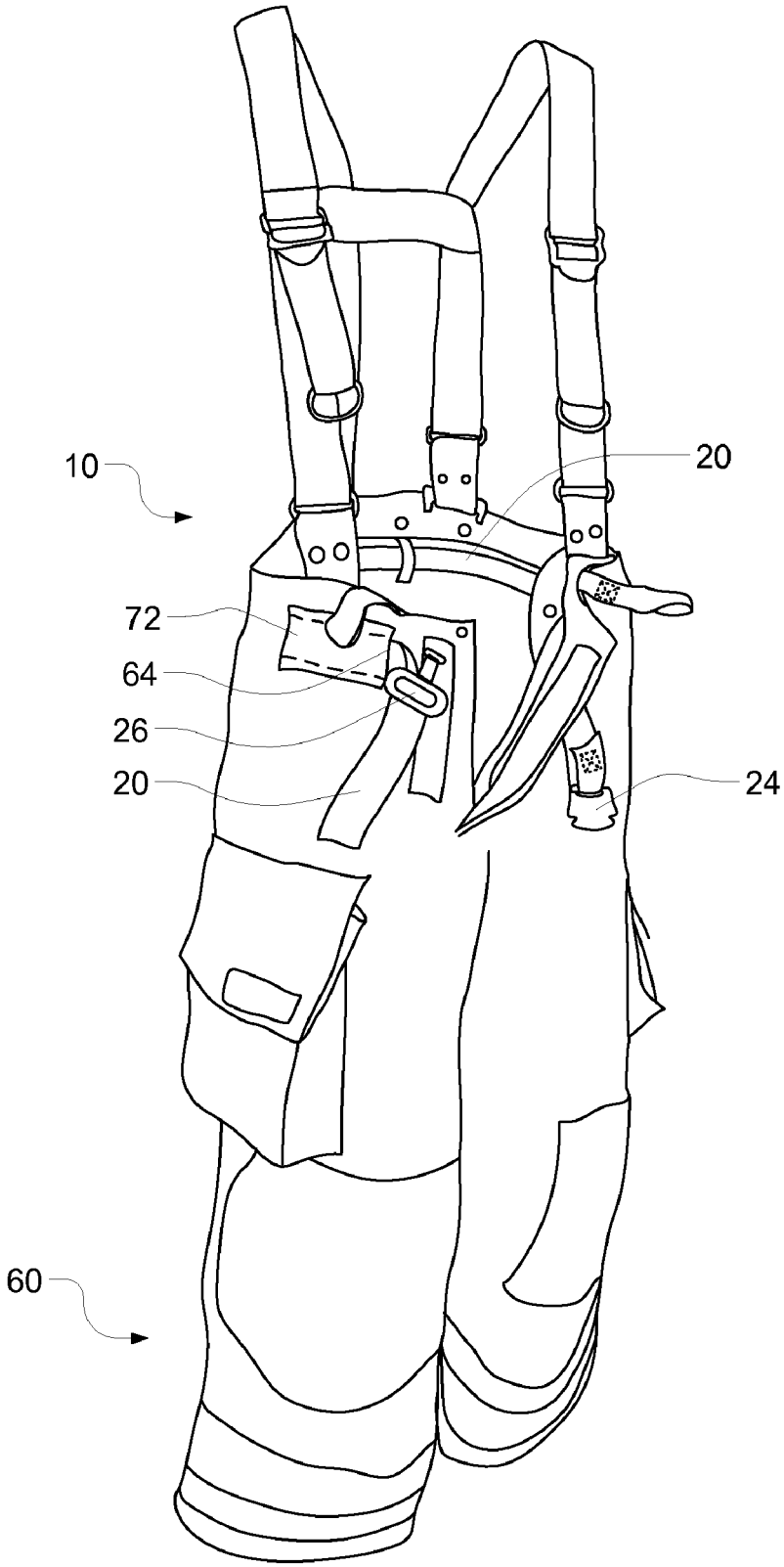
FIG. 2 provides another perspective view of a safety harness and trousers.

The subject matter of this application may involve, in some cases, interrelated products, alternative solutions to a particular problem, and/or a plurality of different uses of a single system or article.

"Floating Harness" describes a safety harness in which support straps are coupled to a waist strap but can move in relation to the waist strap. For instance, the support straps may be capable of sliding vertically without altering the positioning of the waist strap to which they are coupled.

"Selectively Permeable" describes a material that allows the passage of some substances while preventing the passage of others.

"Vapor/liquid Resistant" means that a material with this property can prevent entry of undesirable vapors and/or liquids as well as aerosols. It may be permeable to some substances such as water vapor.

"Resistant barrier layer" means a layer that prevents the passage of a hazardous substance such as a chemical agent or a biological pathogen.

"Water Vapor Permeable" describes a material that is substantially impervious to liquid water but can allow the passage of water vapor at a rate of at least 100 $g/m^2/day$.

A number of different harness types are available to firefighters. For example, U.S. Pat. No. 6,244,379 discloses an automatically adjustable safety harness that may be incorporated into firefighter's trousers. The safety harness includes numerous straps used to adjust the harness. Specifically, it includes position straps that attach the leg loops to the rear of the waist belt to minimize jamming of the wearer's genitals during use. This harness includes leg loops that contract and tighten around the wearer's leg during use. To incorporate the harness into turnout gear, the harness is sewn into a lining and the lining is then fastened to the trousers via hook and loop fasteners. One drawback of this harness may be that because the harness is sewn into the lining and then fastened to the turnout gear, the wearer cannot easily adjust the harness to fit. Furthermore, the wearer may not be able to readily access the harness to unravel the numerous straps that may become twisted or entangled during wear or use.

Numerous recreational climbing harnesses also exist, but these harnesses are not designed for use in conjunction with protective trousers and may be too uncomfortable to be worn when climbing. Therefore, there exists the need for a more comfortable safety harness that can be integrated into turnout gear while maintaining a high degree of safety for the wearer.

In one aspect of the invention, a harness is provided that may be incorporated into apparel, such as firefighter's turnout gear. The harness may be a floating harness that allows different straps of the harness to move in relation to each other. Such a harness can be, for example, simple to use, self-adjusting, non-constricting, and/or can be integrated into firefighter's apparel.

The harness and harness systems described herein may include a design that can provide ease of comfort, use, and maintenance in a system that provides a class II level of protection. A harness may include a waist belt to which one, two, or more support straps are linked. The support strap or straps in turn can be attached to leg straps that encircle the wearer's thighs. The support straps may link to the waist strap, for instance, in front of the wearer via a loop or loops at the upper end of each support strap. The waist belt may pass through the loops but may not be fixed to them, in this manner the support straps can move in relation to the waist strap while remaining attached or linked. Thus, in some embodiments, the support straps may slide upward or downward in relation to the waist strap while still being securely linked to the waist strap. For instance, in a relaxed position with no load applied to the harness, the support straps may sink to a lower position with an upper edge of the support strap loop in contact with the waist belt. In such a position the leg straps may ride loosely on a lower portion of the wearer's thighs providing for increased comfort, for example, when the supporting features of the harness are not necessary. The harness may be integrated with firefighter's trousers.

When a load is applied to the harness, such as when the wearer is being lowered from a structure, the support strap loops may slide upwardly in relation to the waist strap until a lower edge of the support strap loop is retained by a lower edge of the waist strap. In this case the weight of the wearer is supported by the leg straps through the support straps to a rope or cable that is attached to the support strap loops. Some of the weight may also be born by the waist strap, but in many embodiments the purpose of the waist strap may be to keep the support straps close to the wearer's body and to assure that the wearer's center of gravity is below the point of attachment. A point of attachment that is too low may cause instability that would allow the wearer to be turned upside down while being lowered. The waist belt and trousers that can be used with the harness may help to keep the point of attachment close to the wearer's body, also helping to maintain a stable position while lowering.

FIGS. 1-8 illustrate embodiments of the invention where a floating harness 10 can be integrated into firefighter's trousers 60. Although this embodiment is described specifically in the context of a firefighter's trousers, the invention is not limited to use with this type of apparel. Those skilled in the art will appreciate that the present invention may have application in other vocations and avocations such as emergency response, defense and recreational climbing.

Figure 3:
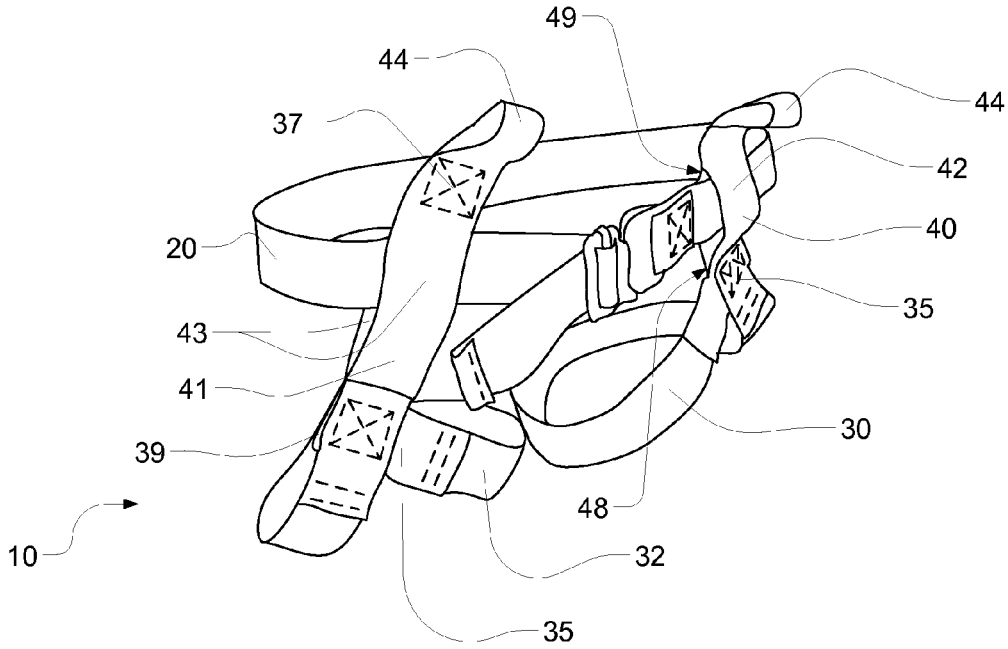
FIG. 3 provides a perspective view of a floating harness.

As illustrated in FIG. 3, the floating harness 10 may include a waist strap 20, leg straps 30 and 32, and support straps 40 and 41 that can be slideably attached to the waist strap 20. Support straps 40 and 41 may be fixed to leg straps 30 and 32, respectively. Two straps that are "fixed" to each other are connected so that they cannot move independently. For example, two straps stitched to each other are fixed while a first strap passing through a loop of a second strap may be connected but not fixed. Leg straps 30 and 32 may be of fixed circumference for encircling a wearer's leg. A strap of fixed circumference may be flexible but the length of the strap does not change when the harness is in use such as when a load is applied. In some cases, however, the length can be adjusted when the harness is not under load, typically with adjustable buckles or clips known to those skilled in the art.

Figure 8:
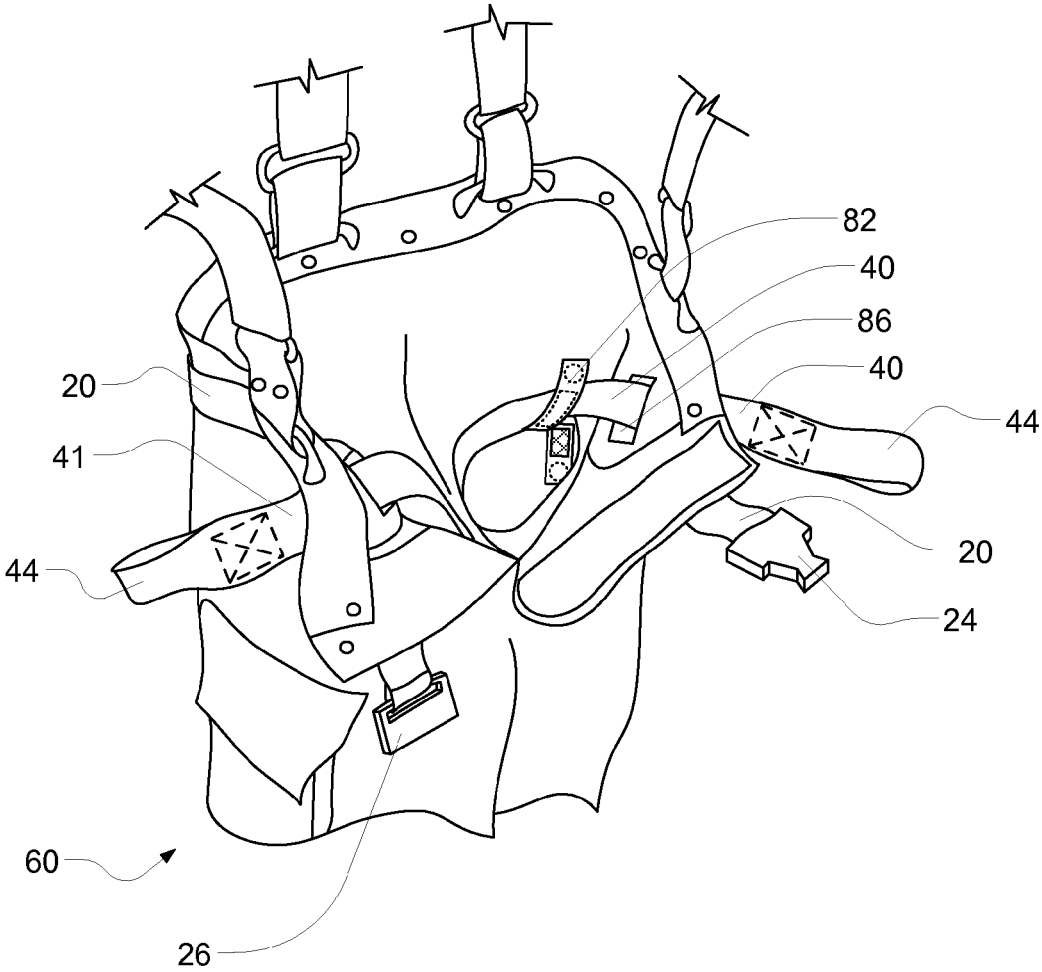
FIG. 8 provides a close up view of another embodiment of a floating harness integrated into firefighter's trousers.
Figure 9:
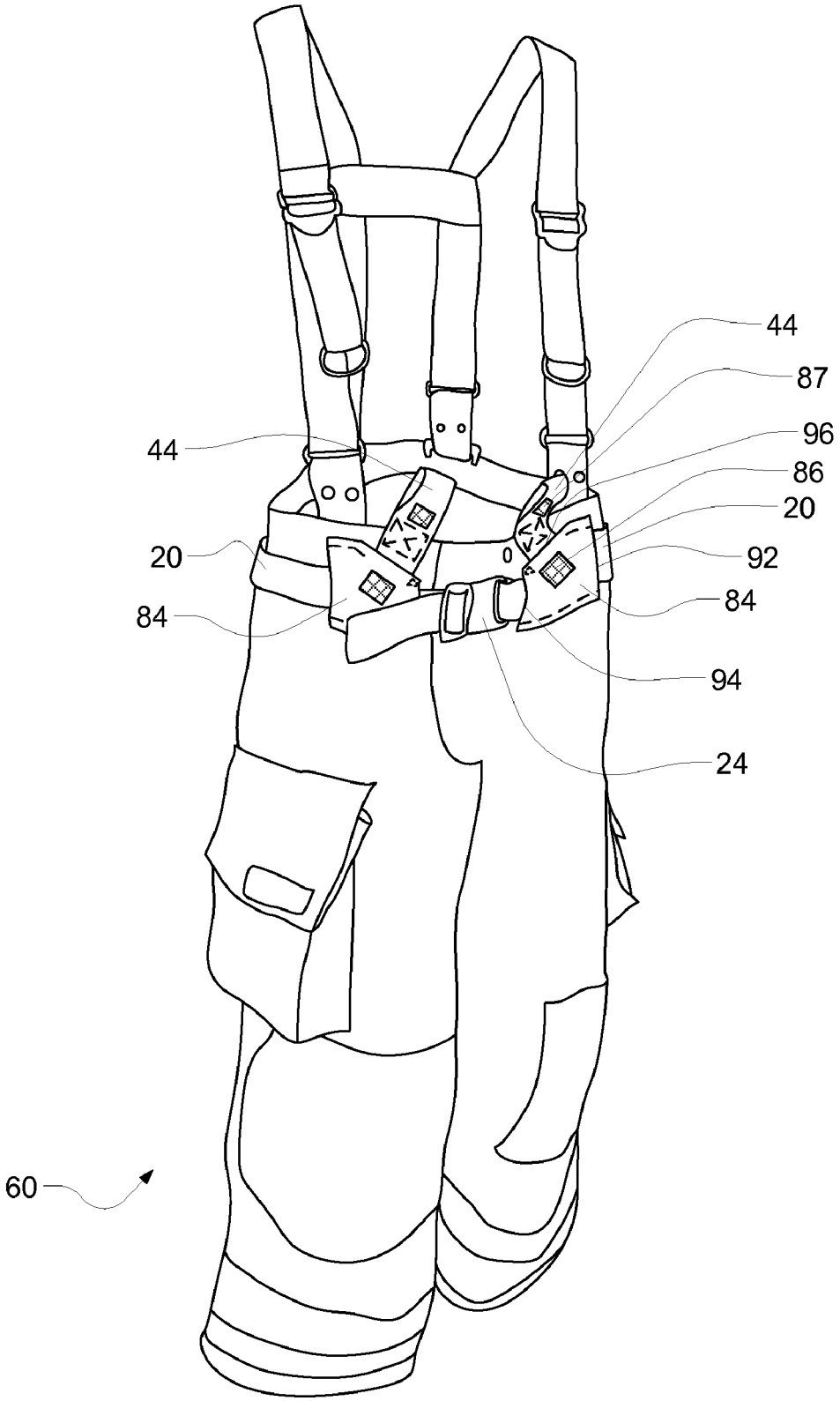
FIG. 9 provides a perspective view of another embodiment of a safety harness and trousers.

Waist strap 20 of the floating harness 10 may be adjustably secured around the waist or trunk portion of the wearer as shown in FIGS. 1 and 9. A fastener may be used to adjustably secure the waist strap. The fastener may be, for example, a buckle. A buckle 22 may include buckle halves 24 and 26 that can be coupled with the ends of waist strap 20 to adjustably secure the waist strap around the waist of the wearer. As shown in FIG. 1, a portion of the waist strap 20 can be coupled to the inside surface of the outside layer of the trousers 60. Alternatively, as shown in FIGS. 8 and 9, waist strap 20 may be positioned outside of the trousers. The end portions of waist strap 20 terminating in buckle halves 24 and 26 can be coupled externally of the trousers through openings 62 and 64. Accordingly, when a firefighter wears the turnout gear with an integrated floating harness, buckle 22 can be fastened externally of the trousers, after the trousers have been donned. In a preferred embodiment, at least the exposed portion of the waist strap 20 and buckle 22 can comprise materials that meet the flame and heat resistance requirements of NFPA standards. In one embodiment, the securing mechanism of the buckle 22 is biased in a closed position by, for example, a spring, so that buckle 22 cannot open when harness 10 is under load.

The straps of harness 10 may be sized and constructed from a material capable of providing support and comfort to the wearer. In particular, the straps may be formed from materials that are sufficiently strong enough to support the wearer under the mechanical and environmental stresses of workplace conditions. The straps may be joined or stitched to provide reinforcement to maintain the proper strength and/or meet the proper standards. Waist straps, support straps and leg straps may be of the same or different materials. A single material or a combination of materials may be used to form the straps. A variety of appropriate materials for the production of harness straps are known to those skilled in the art. Some of these materials include, for example, polyamide, polyester, polybenzimidazole (PBI), nylon, modacrylic, and aramid fibers and/or other natural and polymeric materials. The straps may be joined by methods known to those skilled in the art, such as, by stitching. In a preferred embodiment, the waist strap is about 5 centimeters wide. In other embodiments, the straps may have a width of less than about 2 centimeters, greater than 2 cm, greater than 3 cm, greater than 4 cm, greater than 5 cm or greater than 6 cm.

The floating harness 10 may comprise at least one leg strap 30 of fixed circumference for encircling a wearer's leg. The harness may include a second leg strap 32 of fixed length. As shown in FIG. 3, the leg straps 30 may be of a fixed length or circumference and may not shorten around the wearer's leg when a load is applied to the harness. The leg straps may rest lower (no-load position) on the wearer's leg when there is no load on the harness. When a load is applied (load position) to the harness, the leg straps may be pulled upward and may provide support as they slide up to a thicker portion of the wearer's thigh and/or as the weight of the wearer causes the front of the leg straps to move upwardly while the rear portion of the leg straps maintains a lower position. This extension of the front portion in relation to the rear portion may result in a smaller effective circumference about the thigh without actually changing the length of the leg strap. The no-load position of the leg straps may be lower on the thigh than the load position and the wearer may not be aware of the leg straps when the harness is in a no-load position. In the embodiment shown in FIG. 3, the support straps 40 and 41 are fixedly secured to leg straps 30 and 32 such that the leg straps have a fixed circumference. As shown in FIG. 8, the leg straps may be retained in a substantially fixed position by tab 82. One or more tabs may be used to retain each leg strap and/or support strap in position on an inside surface of the trousers. The straps may be removably retained by the tabs so that they are held in position even when a load is not applied to the harness. The tabs may include a connector such as a hook and loop fastener. This can provide, for example, a system in which the harness can be retained in a comfortable position in the trousers yet can be removed from the trousers when desired.

Similarly to waist strap 20, leg straps 30 and 32 may be sized and constructed from materials to effectively provide support and comfort to the wearer. Furthermore, the leg straps may be sized, widthwise, to maintain their configuration and to minimize the potential of entanglement. It has been found that harnesses made from wider straps (e.g., 5 cm or greater) may be less likely to become entangled during storage or donning. In differing embodiments, the straps may have a width of less than about 2 centimeters, greater than or equal to 2 cm, greater than or equal to 3 cm, greater than or equal to 4 cm, greater than or equal to 5 cm, greater than or equal to 6 cm, or greater than or equal to 8 cm. Additional width of a leg strap can also aid in comfortably distributing the weight of the wearer when a load is applied. An optional liner or liners can also help to distribute the force and to prevent the leg straps from riding up into the groin area.

As shown in FIG. 3, at least one of support straps 40 and 41 may be fixedly secured to a leg strap such that the leg strap has a fixed circumference, and the opposing end of the support strap may be slideably attached to waist strap 20. As shown in, for example, FIGS. 3, 6 and 7, the support straps may slide laterally along the waist strap and/or vertically with respect to the waist strap. A support strap and leg strap may be formed together from a unitary strap, as is shown in FIG. 3.

In some embodiments, the harness may include a first and second support strap. Other embodiments of the invention may comprise one support strap fixedly secured to both leg straps. If a single support strap is used with two leg straps the single support strap may pass through a single guide in trousers 60.

Support strap 40 may form a support loop 42 (or 43) such that support strap 40 can be slideably retained by waist strap 20. The support loop may form all, or a portion of, the support strap. Waist strap 20 may pass through support loop 42, as shown in FIG. 3. Support loops 42 and 43 enable support straps 40 and 41 to move from a rest position (down) to a working position (up) (see FIGS. 6 and 7). The rest position may be when there is no load on the support straps and the top edge of the waist strap 20 is substantially near, or in contact with, the upper edge of support loop 42. The working position may be where there is a load on the support strap, that is, the harness is in use, and the top edge of the waist strap is not substantially near the upper edge of support loop 42. Although some of the load may be distributed to the waist strap, most of the load may be born by the leg straps. The distance between the rest position and the working position is essentially the distance between the lower edge 48, and the upper edge 49 of support loop 42 minus the width of waist strap 20. This distance is herein defined as the "stroke length" of the support strap, and may be, for example, greater than 5 cm, greater than 10 cm, greater than 15 cm, or greater than 20 cm Support strap 40 and waist strap 20 may be constructed and arranged so that the support strap can slide laterally along the whole length of the waist strap 20, less than half the length of the waist strap 20 or less than one quarter the length of the waist strap 20.

The free end of support strap 40 above support loop 42 may be formed into (or attached to) a second loop (fastening loop) or other fastening feature that provides a means for securely attaching the harness to a carabiner, rope, cable, or the like. For example, fastening loop 44 may be formed by folding the strap back on itself and stitching the overlapping portions together. Fastening loop 44 may be accessible on the exterior of the trousers when the floating harness is used with a firefighter's ensemble.

Although components of the harness 10 are described as discreet parts, in some embodiments a single strap may be configured as a leg strap with a coupled support strap as shown in FIG. 3. In this embodiment, end 35 of the strap is fixedly secured to a more central portion of the strap to form the leg strap 30; the opposite end of the strap may then be looped back and stitched near or at the same point as end 35. This may result in a single large loop that includes both support loop 42 and fastening loop 44. By stitching a portion of the large loop to an opposing portion of the same loop at point 37, the large loop can be divided into separate support loops and fastening loops, as shown in the figures. This integral leg and support strap may, for example, simplify manufacturing and can help to prevent entanglement of the harness when in use or in storage. A left leg/support strap may be, in some cases, a right leg/support strap that has been turned inside-out.

In some embodiments the floating harness 10 may be void of additional straps, such as rear or seat straps. Many traditional harnesses typically include rear straps or seat straps that couple the leg loops to the rear portion of the waist strap. In some embodiments, the floating harness may consist essentially of three straps—a waist strap and two support/leg strap combinations. The use of three components: the waist, leg and support straps, or two components (in an embodiment with a unitary leg and support strap) minimizes the likelihood of the straps twisting and entangling. Manufacturing can also be simplified. The floating harness 10 can be self-adjusting and may not require adjustment or may only require adjustment of the waist strap.

In another aspect, the invention relates to trousers 60 for retaining the floating harness. Trousers 60 may include a number of layers such as an inner thermal layer 68 and outer layer 69. The trousers may also include features such as a retainer 62, a guide 66, and/or an opening 64 to facilitate the retention of the floating harness in the trousers. Materials that may be used in the construction of the trousers are known to those skilled in the art. Some of these materials are described in U.S. patent application titled PROTECTIVE APPAREL FOR FIREFIGHTERS AND EMERGENCY RESPONDERS, Ser. No. 11/615,262, filed on Dec. 22, 2006. This patent application is hereby incorporated by reference herein.

The trousers may include a resistant barrier liner or layer that can substantially prevent the intrusion of toxic chemicals, biological pathogens, and radioactive particles. Such trousers may be referred to as C/B or CBRN trousers. The trousers may also include a thermal liner. A liner may serve to improve the comfort of the harness system as well as to keep the harness straps properly configured in the trousers.

In some embodiments, the inner layer of the trousers may be removably coupled to the outer layer with the floating harness positioned between the layers. The leg portions of inner layer 68 may be passed through the leg straps 30 of the floating harness 10, the leg straps being positioned between the leg portions of the inner layer 68 and outer garment 69. Inner layer 68 may be coupled to outer garment 69 by fasteners 74. Fasteners 74 such as, for example, buttons, hook and loop, snaps, or zippers, may be used to join layers together, either temporarily or permanently. In one embodiment, inner layer 68 can be removably joined to waistband 72 of the trousers with snaps 74, and harness 10 may be integrated between the inner layer and outer garment. With the harness between the inner layer and outer garment, the harness becomes a part of the firefighter's ensemble such that when the firefighter dons the trousers, the firefighter also dons the harness. When the harness is not in use—with the leg straps loosely encircling the wearer's leg—the firefighter may not even realize that the harness is in place. When the harness is in use, an inner layer, such as a thermal layer, may help provide cushioning around the leg strap areas.

Trousers 60 may include a waistband 72. Support strap guide(s) 66 for slideably retaining a support strap 40 may pass through the waistband. The guide 66 may pass substantially vertically through the waistband 72 such that the guide 66 is constructed and arranged to slideably receive one or more support straps 40 of the floating harness. This positioning may help to make the support straps accessible when the ensemble includes a coat that overlaps a portion of the trousers. Fastening loop 44 may be configured to avoid slipping back through the guide 66 when the harness is in the no-load position. The width of guide 66 may be greater than or equal to the width of the support strap. Preferably, the arrangement of guide 66 and opening 64 in the trousers is such that when a load is applied to the harness, the forces are distributed evenly access the leg straps. The guide 66 and opening 64 may be positioned so that the fastening point is above the wearer's center of gravity (when upright), and/or close to the wearer's body, to maintain the wearer in a generally upright position when loaded. For example, if the wearer is being lowered from a building, the positioning of the guide may help to keep the wearer in a generally upright position when in the load position.

Trousers for retaining the floating harness may include at least one opening 64 to enable waist strap 20 to be fastened or adjustably fastened externally of the trousers. In one embodiment, two openings may be formed in the waist band of the trousers to provide a pathway for two connectable ends 24 and 26 of waist strap 20. This may help, for example, to align the waist strap of the harness with the waist band of the trousers, providing for proper positioning of the harness within the trousers. It may also provide for external adjustment of the harness waist strap, allowing the wearer to tighten (or loosen) the harness waist strap instantaneously while wearing gloves. This may allow the wearer to keep the harness in a substantially loose and comfortable position under most circumstances while providing for fast, secure tightening of the waist strap when the harness is needed.

The waist band of the trousers may include several layers of material with reinforced stitching, and the waist band may be an area of added structural strength in the trousers. When waist strap 20 is threaded through openings 62 and 64, the harness 10 may be securely joined to and/or positioned within the trousers. Preferably, the openings are positioned in the front portion of the trousers to provide for easy fastening of the waist strap buckle. The size of opening 64 may be, for instance, greater than or equal to the width of the waist strap 20 of the harness. Reinforcement around the opening may help to provide added strength and longer wear, for example.

When trousers comprising multiple layers (abrasion resistant outer layer, thermal inner layer, for example) are used, harness 10 may be positioned outside the outer layer, inside of the inner layer, or between an inner layer 68 and an outer layer 69 of the trousers. Leg straps 30 may be positioned outside the leg portions of the inner layer 68 and the inside the outer layer 69. Thus, the harness can be donned properly and quickly by simply stepping into the multiple layer trousers.

Figure 4:
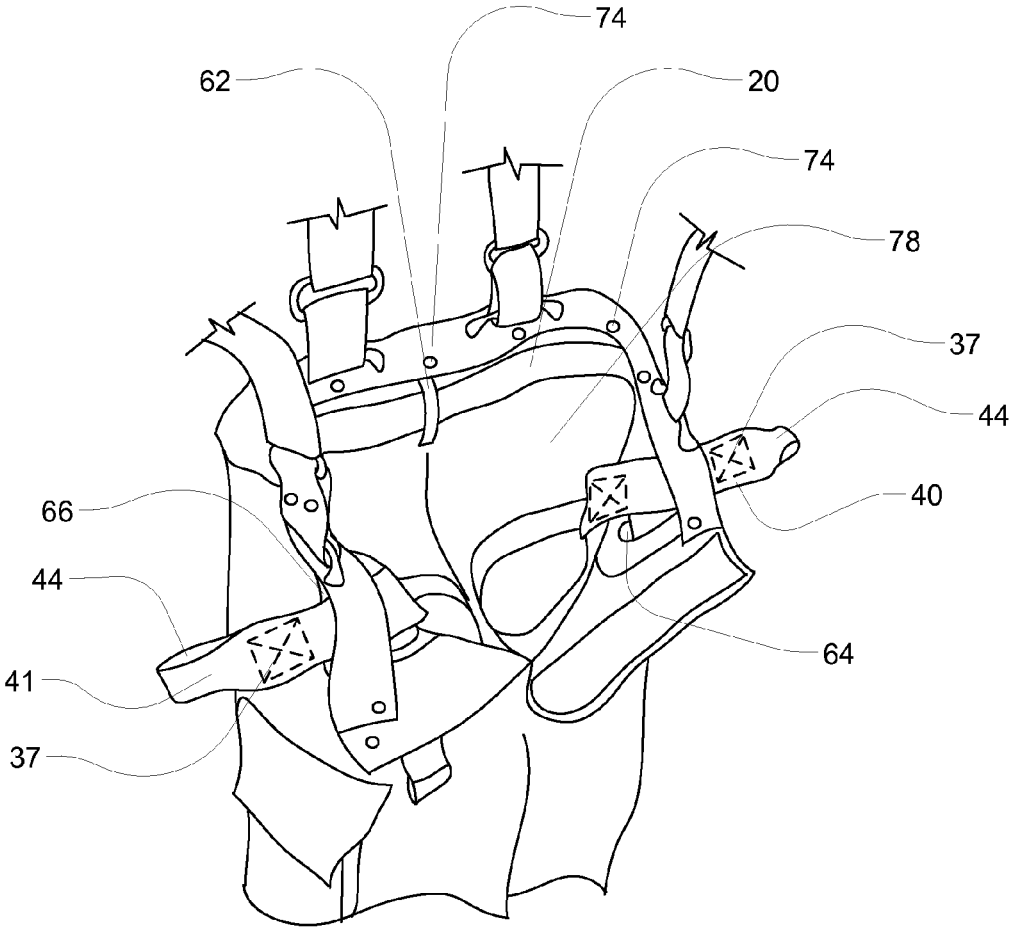
FIG. 4 provides a close up view of a floating harness integrated into firefighter's trousers.
Figure 5:
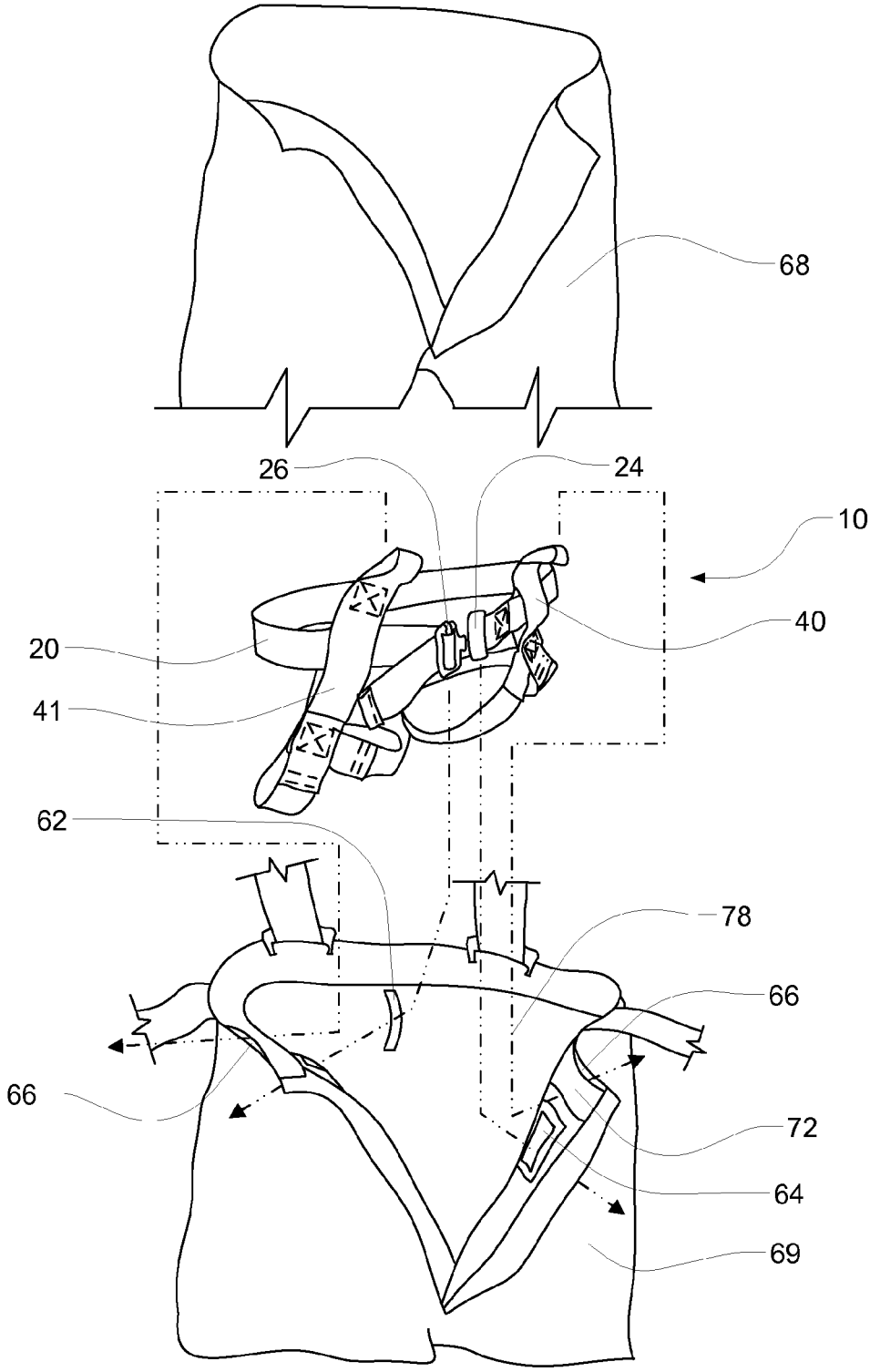
FIG. 5 provides a perspective view of how a floating harness, trouser liner, and trouser outer layer may be integrated together.

The floating harness 10 may be removably or permanently coupled to an inside surface of the trousers. A buckle passing through openings 64 can provide one anchoring point. A second anchoring point may be provided by retainer 62 through which waist strap 20 may be slideably retained. Retainer 62 may be preferably positioned on the inside surface of the trouser outer layer, in the rear portion of the trousers. Retainer 62 may retain the waist strap 20 on the inside surface 78 of the outer layer of the trousers. The retainer may be, for example, a button, flap, loop, or a slot, and may slideably retain the waist strap. If the retainer is a button, the waist strap may have a means such as buttonhole to facilitate non-slidable retention of the waist strap. In one embodiment, the retainer 62 is a substantially vertically oriented loop attached to an inside surface of the outer layer of the trousers. As shown in FIGS. 4 and 5, retainer 62 may be in the rear waist portion of the trousers may be attached to the waistband 72 of the trousers. In one embodiment, the wearer may pass the waist strap 20 through loop 62 to slideably retain the waist strap 20 in the inside surface of the trousers. In another embodiment, wherein the retainer is a securable flap, the flap may be secured over the waist strap to retain the waist strap in position. The flap may be secured with, for example, a button, hook and loop fasteners (VELCRO®), or other securing means known to those of skill in the art.

Figure 6:
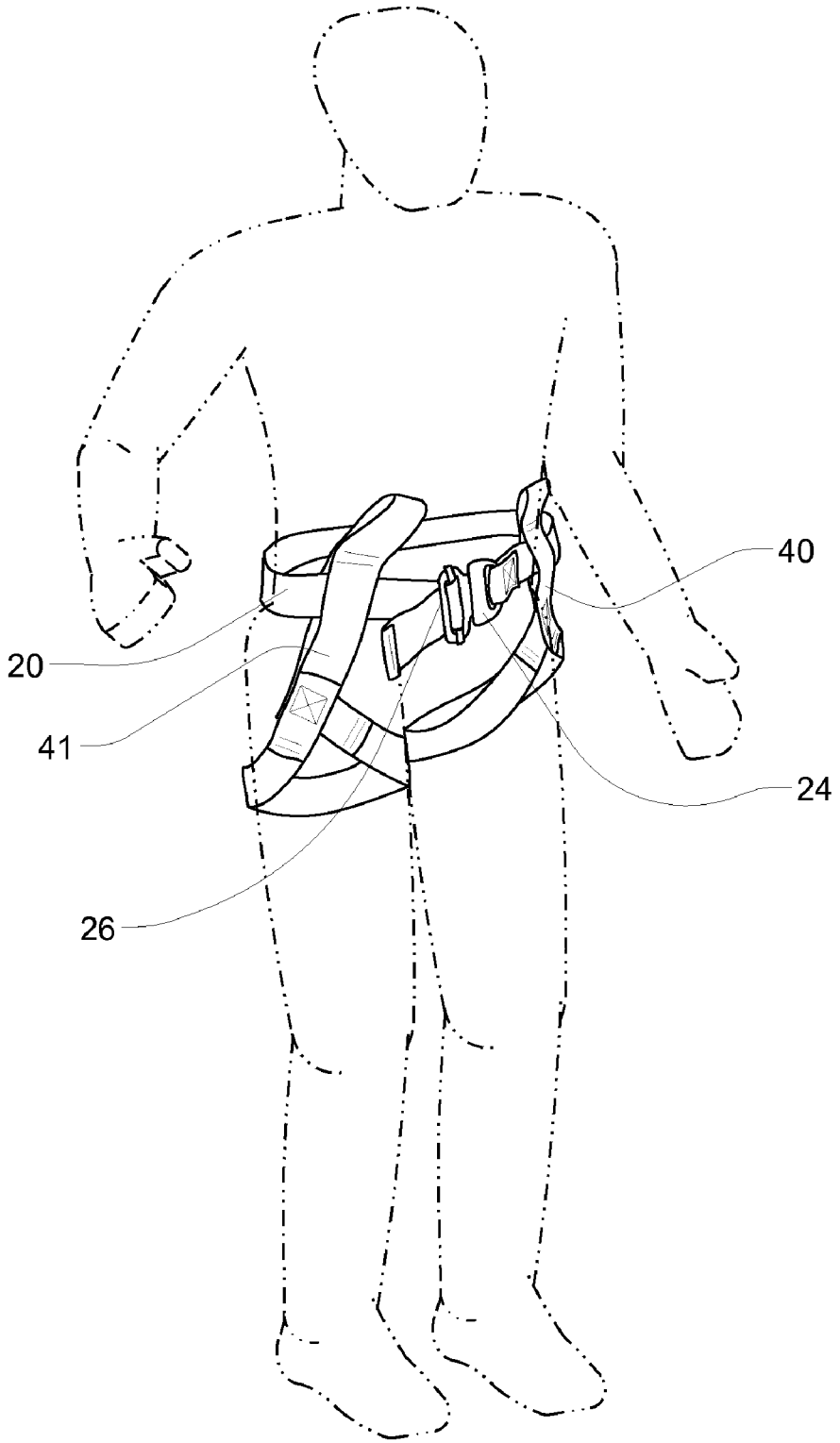
FIG. 6 provides a view of a floating harness on a wearer under a no-load condition.
Figure 7:
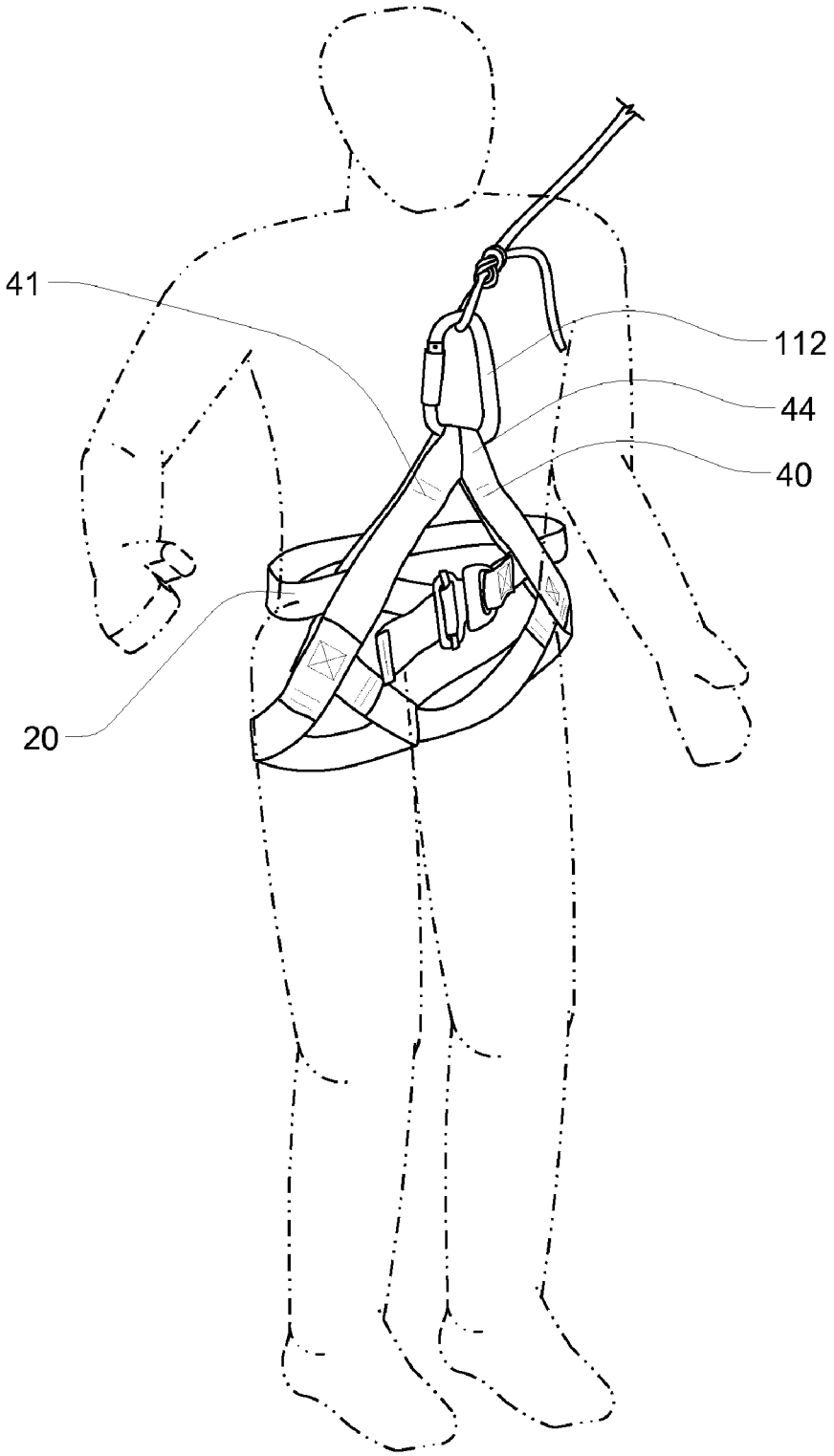
FIG. 7 shows the harness of FIG. 6 under a load condition.

In an embodiment illustrated in FIGS. 8 and 9, waist strap 20 may pass around the exterior of trousers 60. The trousers may include slit 86 allowing support strap 40 to pass from the interior to the exterior of the trousers. Slit 86 may be reinforced to resist wear and may be sized to allow passage of a support strap without providing a path of entry for chemical and biological contaminants. Waist strap 20 may be held in position on the trousers by one or more loops or connectors. Belt retainer 84 may position and retain support strap 40 as well as waist strap 20. The belt retainer may be positioned to provide for a comfortable and/or safe positioning for the point of attachment during a rescue. Belt retainer 84 may be made of material similar or identical to that of trousers 60. Belt retainer 84 may be stitched to or otherwise affixed to the trousers and may include slots 92, 94 and 96 for receiving waist strap 20 and support strap 40. Waist strap 20 may pass into slot 92 and out of slot 94. Support strap 40 may pass through slot 96. Slit 86 in trousers 60 and slot 96 may be aligned so that support strap 40 can pass through each of slit 86 and slot 96 and can be manipulated vertically without significant interference. Although not seen in FIGS. 8 and 9, support strap 40 may still be coupled to waist strap 20 as shown in FIGS. 3, 6 and 7, for example. Thus, once the waist strap has been secured around the wearer, waist strap 20 may remain substantially immobile in relation to belt retainer 84 while support strap 40 may slide vertically through belt retainer 84. Trousers 60 may include one or more permanent or detachable loops on the side and or rear of the trousers for retaining waist strap 20 in position.

Belt retainer 84 may include a portion of a fastener such as loop portion 86 of a hook and loop fastener. Fastening loop 44 may include a complementary fastener such as hook portion 87 that is positioned to mate with loop portion 86 when fastening loop 44 is folded down onto belt retainer 84. This may help retain fastening loop 44 in a secure, unobtrusive position when the harness is not being used to rescue the wearer. When the fastening loop needs to be attached to a rescue line it may be easily and instantly accessible. Thus, in different embodiments, fastening loop 44 may either be retracted substantially into the trousers or may be folded down and secured to the exterior of the trousers.

In another aspect, the invention relates to a method of coupling an anchoring device to support straps 40 and 41. A fastener, such as a carabiner 112, or a loop of rope, for example, may be fastened to the exteriorly accessible support straps 40 and/or 41. In one embodiment where the support strap is a single continuous strap joining both leg straps, the wearer may simply couple the fastener to the support strap itself. In another embodiment, where support straps 40 and 41 are separately and fixedly secured to both the first and second leg straps, the fastener may be secured to each support strap 40 via the fastening loop 44 as shown in FIG. 7. As the wearer's weight is applied to the harness, fastening loops 44 and support straps 40 and 41 may be pulled upward until the bottom seam of the support loop 42 is retained by the waist strap 20. Waist strap 20 may remain substantially stationary while the support straps slide through guides 64. Preferably, this results in the wearer's center of gravity being below the point of attachment when the wearer is suspended in a substantially upright position. With the wearer's center of gravity below the point of attachment, the wearer's body may be maintained in a generally upright position during the lowering process.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto; the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined. Other elements may optionally be present other than the elements specifically identified by the "and/or" clause, whether related or unrelated to those elements specifically identified unless clearly indicated to the contrary.

All references, patents and patent applications and publications that are cited or referred to in this application are incorporated in their entirety herein by reference.

What is claimed is:

1. A floating harness comprising:

a waist strap;

a first unitary strap slidably connected to the waist strap, the first unitary strap comprising:

a first leg strap formed by fixing a first end of the first unitary strap to a first portion of the first unitary strap, wherein the first leg strap is of fixed circumference for encircling a wearer's leg; and a first support strap formed by folding a second end of the first unitary strap back onto a second portion of the first unitary strap and fixing the second end of the first unitary strap to the second portion of the first unitary strap, wherein the second support strap includes:

a first support loop that is slidably attached to the waist strap and configured to be vertically slidable around the waist strap by a distance greater than 5 centimeters; and, a first fastening loop distal to the first leg strap; and a second unitary strap slidably connected to the waist strap, the second unitary strap comprising:

a second leg strap formed by fixing a first end of the second unitary strap to a first portion of the second unitary strap, wherein the second leg strap is of fixed circumference for encircling a wearer's leg; and a second support strap formed by folding a second end of the second unitary strap back onto a second portion of the second unitary strap and fixing the second end of the second unitary strap to the second portion of the second unitary strap, wherein the second support strap includes:

a second support loop that is slidably attached to the waist strap and configured to be vertically slidable around the waist strap by a distance greater than 5 centimeters; and a second fastening loop distal to the leg strap;

wherein the waist strap has a major length and the first support strap and the second support strap are slidable laterally along at least a quarter of the major length of the waist strap.

2. The floating harness of claim 1, wherein the first support strap and the second support strap are vertically slidable around the waist strap by a distance greater than 10 centimeters.

3. The floating harness of claim 1, wherein the waist strap is retained by the first support strap and the second support strap, and wherein the waist strap is not fixed to the first support strap and the second support strap.

4. The floating harness of claim 1, comprising a fastener for adjustably securing the waist strap.

5. The floating harness of claim 1, comprising a buckle that is locked when the harness is under a load.

6. The floating harness of claim 5, wherein the buckle is biased in a closed position by a spring.

7. The floating harness of claim 1, wherein the waist strap and the first unitary strap and the second unitary strap are made from a material selected from the group consisting of polyamide, polyester, polybenzimidazole (PBI), nylon, modacrylic, and aramid fibers, and combinations thereof.

8. The floating harness of claim 1, wherein:

the first support loop and the second support loop are slidably attached to the waist strap in a direction substantially perpendicular to a length of the waist strap;

the first unitary strap is coupled to the waist strap by only the first support loop and the second unitary strap is coupled to the waist strap by the second support loop; and the waist strap can be completely removed from within the first support loop and the second support loop.

9. The floating harness of claim 1, wherein the first unitary strap and the second unitary strap are slidably attached to the waist strap in both a perpendicular and a parallel direction in relation to a length of the waist strap such that the first unitary strap and the second unitary strap can simultaneously slide in directions perpendicular and parallel to the length of the waist strap.

10. The floating harness of claim 1, wherein:

the first portion of the first unitary strap and the second portion of the first unitary strap comprise the same point on the first unitary strap; and the first portion of the second unitary strap and the second portion of the second unitary strap comprise the same point on the second unitary strap.

* * * * *